US006202662B1

(12) United States Patent
Lin

(10) Patent No.: US 6,202,662 B1
(45) Date of Patent: Mar. 20, 2001

(54) VENTILATED UMBRELLA

(76) Inventor: Yao-Chin Lin, No. 21, Alley 24, Lane 273, Sec. 3, Tungmen Rd., Tainan (TW)

( * ) Notice: Subject to any disclaimer, the term of this patent is extended or adjusted under 35 U.S.C. 154(b) by 0 days.

(21) Appl. No.: 09/290,268

(22) Filed: Apr. 13, 1999

(30) Foreign Application Priority Data

Mar. 5, 1999 (TW) ..... 88203363

(51) Int. Cl.[7] ..... A45B 25/26; A45B 25/22
(52) U.S. Cl. ..... 135/33.7; 135/33.2
(58) Field of Search ..... 135/33.7, 15.1, 135/33.2, 33.4

(56) References Cited

U.S. PATENT DOCUMENTS

D. 162,617 * 3/1951 Benivegna ..... 35/33.7 X
1,774,909 * 9/1930 Wells ..... 135/33.2 X
3,032,047 * 5/1962 Wendorf ..... 135/33.7
3,456,661 * 7/1969 Faely ..... 135/33.7
4,865,063 * 9/1989 Williams ..... 135/33.7
5,078,166 * 1/1992 Lee ..... 135/33.7
5,115,827 * 5/1992 Lee ..... 135/33.7
6,006,769 * 12/1999 Lin ..... 135/33.7
6,039,063 * 12/1999 Lin et al. ..... 135/33.7

* cited by examiner

*Primary Examiner*—Robert Canfield
(74) *Attorney, Agent, or Firm*—Jackson Walker L.L.P.

(57) ABSTRACT

A ventilated umbrella includes a support frame forming a tetragonal surface, a first canopy secured on the tetragonal surface of the support frame and having an outer edge, a loop-shaped second canopy secured on the tetragonal surface of the support frame and having an inner edge located under the outer edge of the first canopy, a gap defined between the first canopy and the second canopy, and a plurality of elastic members each having a first end secured to the support frame, and a second end secured to the inner edge of the second canopy. In such a manner, the gap between the outer edge of the first canopy and the inner edge of the second canopy is increased by the drawing force of the elastic members, thereby enhancing the ventilation effect.

3 Claims, 5 Drawing Sheets

VENTILATED UMBRELLA

CROSS-REFERENCES TO RELATED APPLICATIONS

Not Applicable.

BACKGROUND OF THE INVENTION

1. Field of the Invention

The present invention relates to a ventilated umbrella.

2. Description of the Related Art

A first conventional ventilated umbrella in accordance with the prior art shown in FIG. 5 comprises a support frame (40) having a plurality of ribs (41), and a composite canopy (3) attached to the support frame (40). The composite canopy (3) includes a main canopy (30) attached to the ribs (41) of the support frame (40) and contains a plurality of openings (301), and an auxiliary canopy (31) mounted on the main canopy (30) to cover the openings (301). In such a manner, air is able to flow through the gap defined between the main canopy (30) and the outer edge (311) of the auxiliary canopy (31) into the openings (301), thereby enhancing the ventilation effect of the umbrella.

However, the auxiliary canopy (31) snugly abuts the main canopy (30) when the support frame (40) is fully expanded such that the gap between the main canopy (30) and the outer edge (311) of the auxiliary canopy (31) is too small to allow the air access to the openings (301), thereby decreasing the ventilation effect. In addition, the auxiliary canopy (31) significantly overlaps the main canopy (30), thereby increasing the cost of manufacturing.

A second conventional ventilated umbrella in accordance with the prior art shown in FIG. 6 comprises a support frame (60) having a plurality of ribs (61), and a composite canopy (5) attached to the support frame (60). The composite canopy (5) includes a main canopy (50) attached to the ribs (61) of the support frame (60) and containing therein an opening (500) in which a net (501) is mounted, and an auxiliary canopy (51) mounted on the main canopy (50) to cover the net (501). In such a manner, air is able to flow through the gap defined between the main canopy (50) and the outer edge (511) of the auxiliary canopy (51) into the net (501), thereby enhancing the ventilation effect of the umbrella.

However, the auxiliary canopy (51) snugly abuts the main canopy (50) when the support frame (60) is fully expanded such that the gap between the main canopy (50) and the outer edge (511) of the auxiliary canopy (51) is too small to allow the air access to the net (501), thereby decreasing the ventilation effect. In addition, the auxiliary canopy (51) significantly overlaps the main canopy (50), thereby increasing the cost of manufacturing.

The present invention has arisen to mitigate and/or obviate the disadvantage of the conventional ventilated umbrella.

BRIEF SUMMARY OF THE INVENTION

In accordance with one aspect of the present invention, there is provided a ventilated umbrella comprising a support frame forming a tetragonal surface, a first canopy secured on the tetragonal surface of the support frame and having an outer edge, a loopshaped second canopy secured on the tetragonal surface of the support frame and having an inner edge located under the outer edge of the first canopy, a gap defined between the first canopy and the second canopy, and a plurality of elastic members each having a first end secured to the support frame, and a second end secured to the inner edge of the second canopy.

The first canopy has a dimension smaller than the tetragonal surface of the support: frame.

The support frame includes a shaft, and a retaining ring secured on the shaft, and the first end of each of the elastic members is attached to the retaining ring. The retaining ring contains a plurality of locking holes therein, and the first end of each of the elastic members includes a locking hook secured in one of the locking holes.

Further benefits and advantages of the present invention will become apparent after a careful reading of the detailed description with appropriate reference to the accompanying drawings.

DETAILED DESCRIPTION OF THE INVENTION

Figure 1:
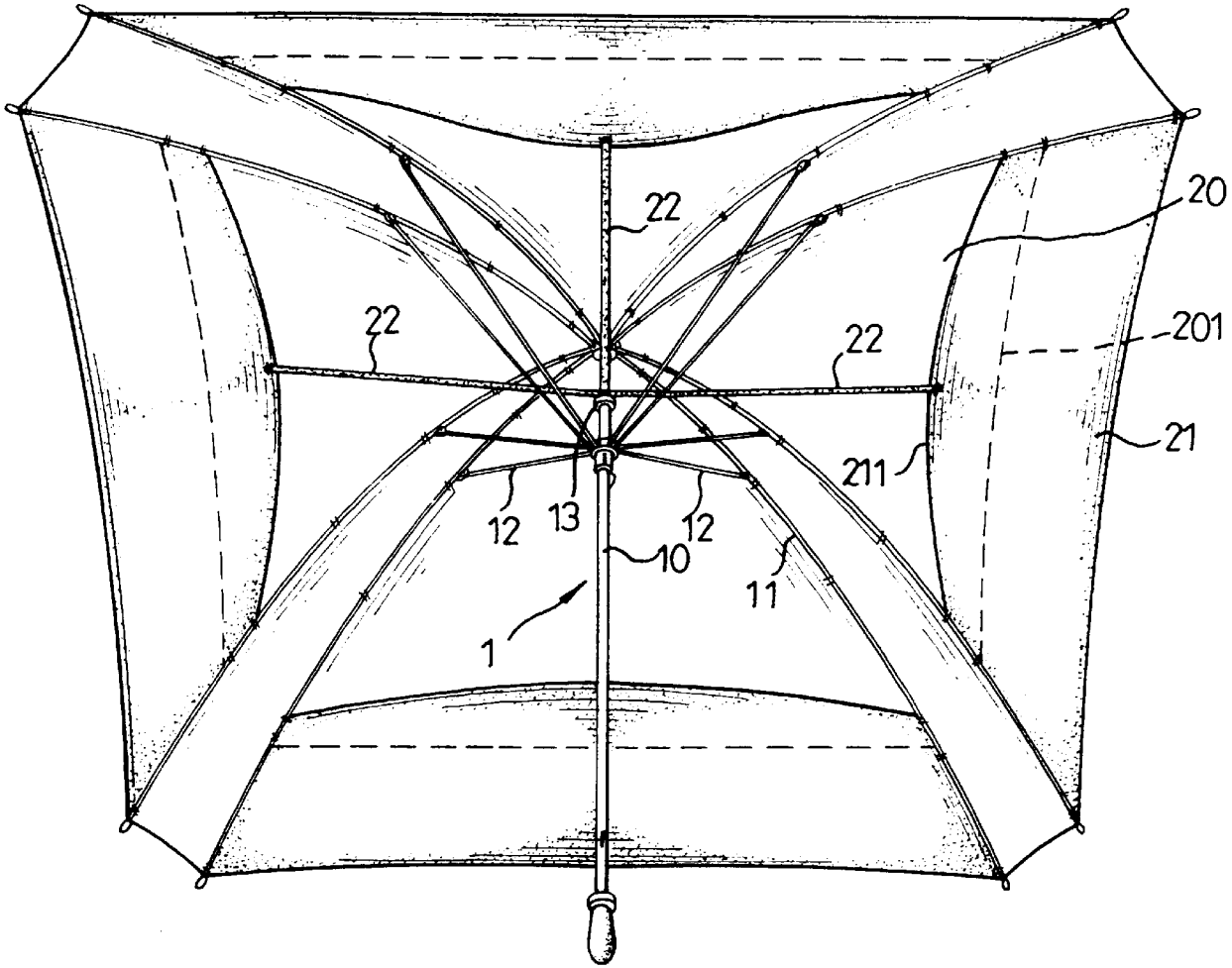
FIG. 1 is a bottom perspective view of a ventilated umbrella in accordance with the present invention.
Figure 2:
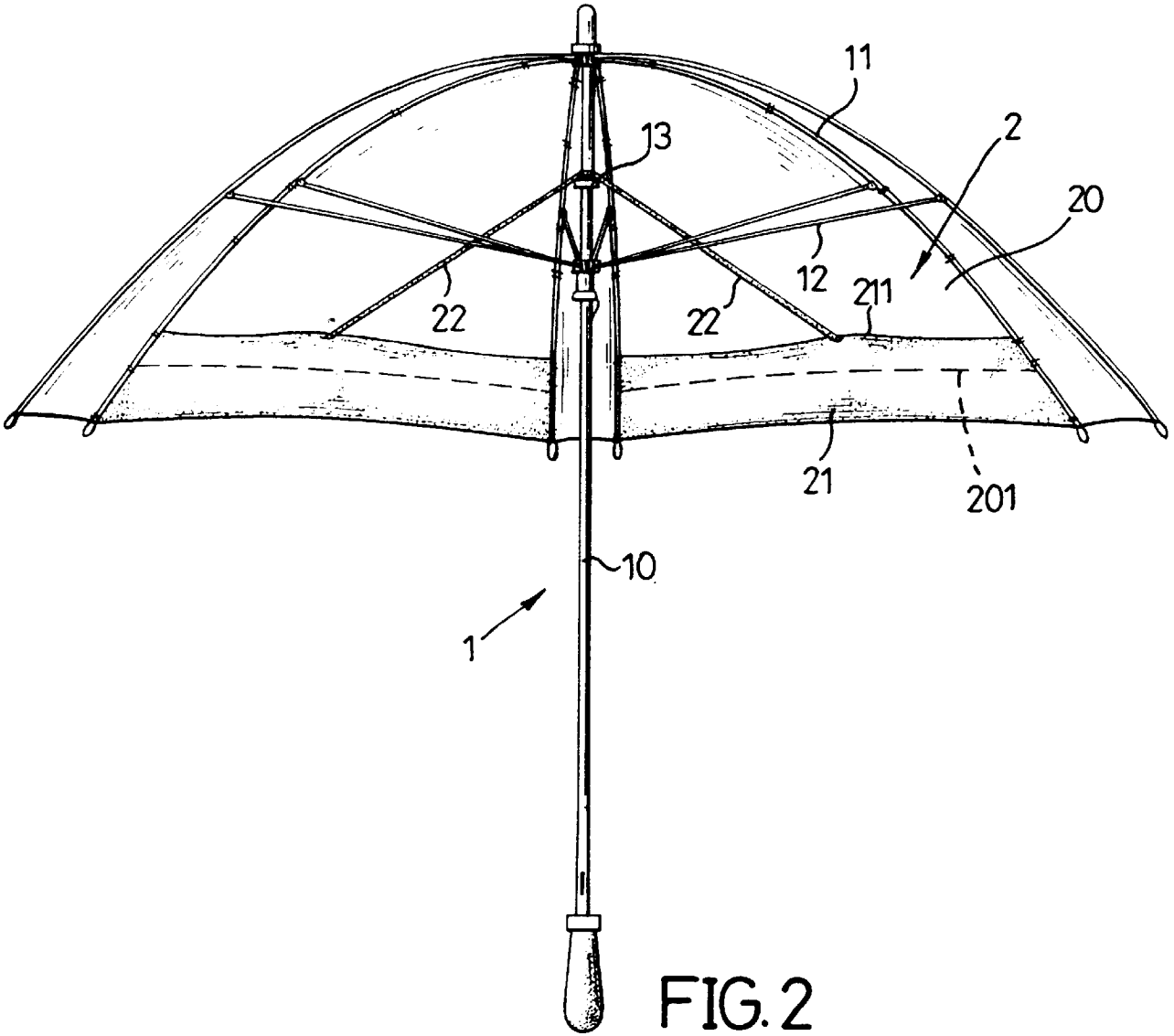
FIG. 2 is a partially cut-away front plan view of the ventilated umbrella as shown in FIG. 1.
Figure 3:
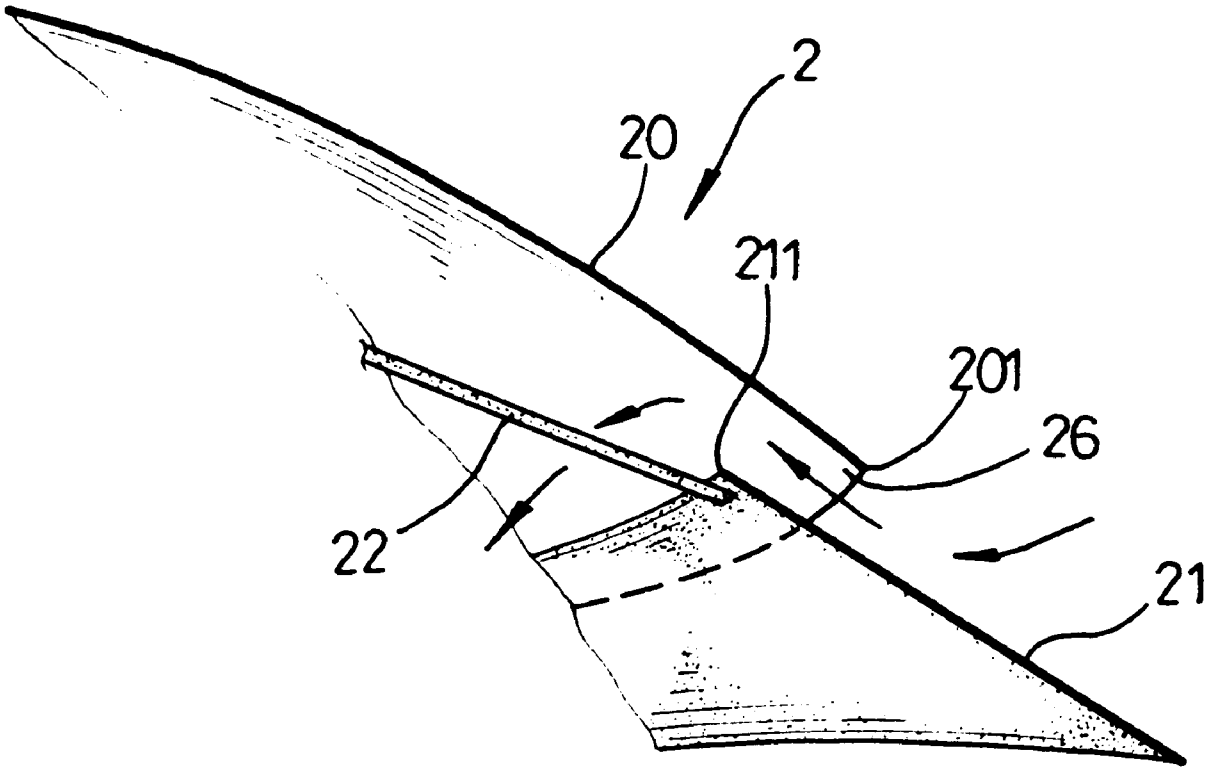
FIG. 3 is a partially cut-away side plan view of the ventilated umbrella as shown in FIG. 1.
Figure 4:
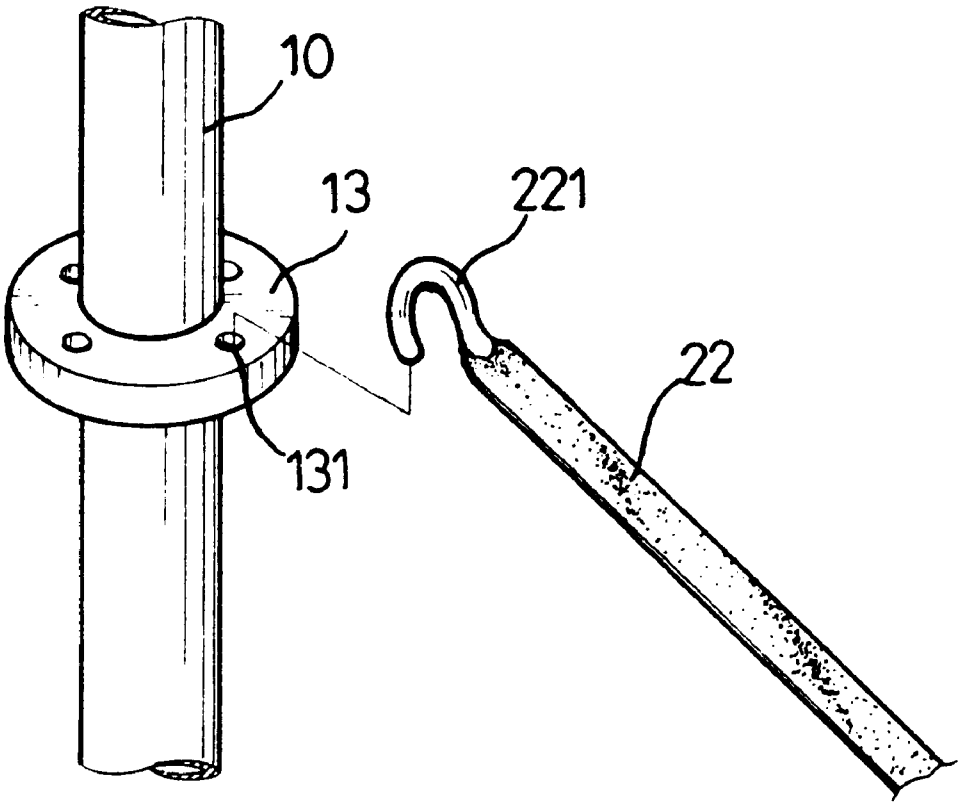
FIG. 4 is an exploded perspective view showing an elastic rope being attached to a retaining ring.
Figure 5:
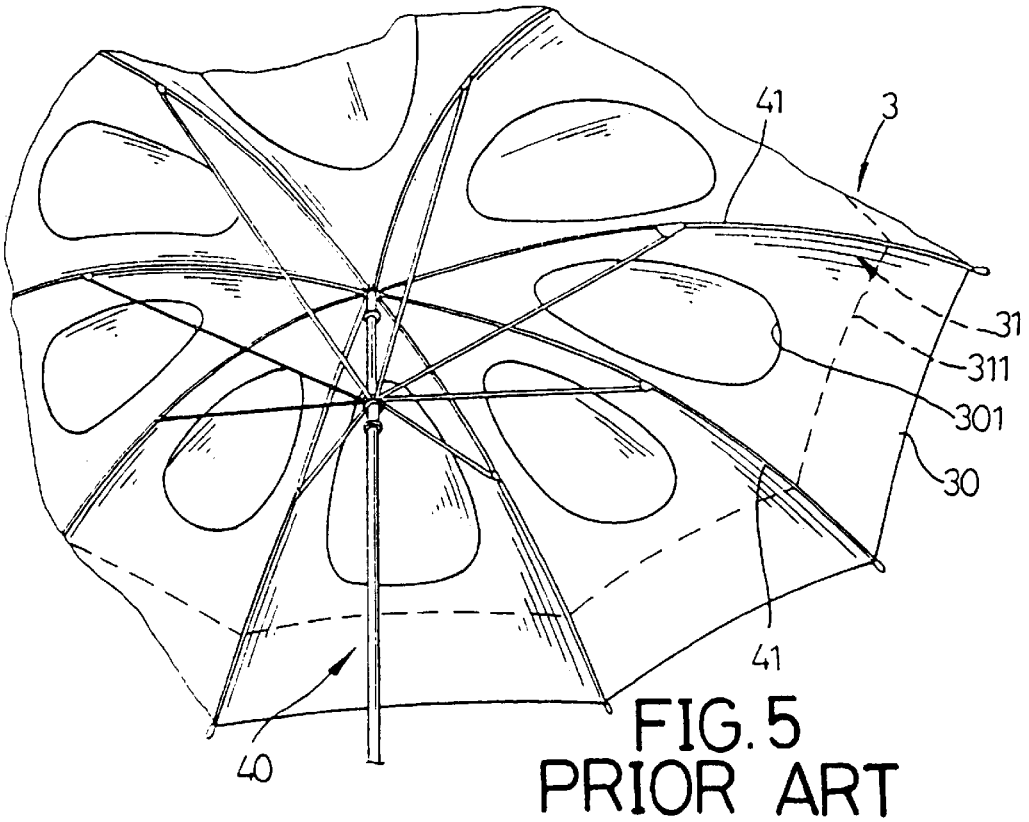
FIG. 5 PRIOR ART
FIG. 5 is a bottom perspective view of a first conventional ventilated umbrella in accordance with the prior art.
Figure 6:
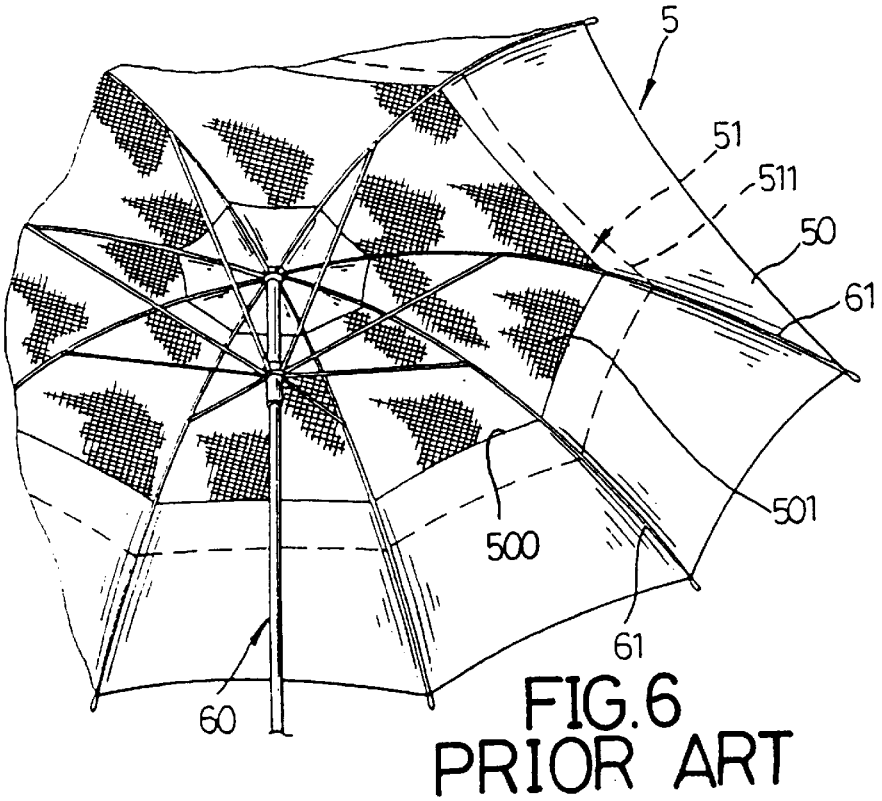
FIG. 6 PRIOR ART
FIG. 6 is a bottom perspective view of a second conventional ventilated umbrella in accordance with the prior art.

Referring now to FIGS. 1–3, a ventilated umbrella in accordance with the present invention comprises a support frame (1), and a composite canopy (2) attached to the support frame (1).

The support frame (1) includes a shaft (10), a plurality of ribs (11), and a plurality of stretchers (12). The support frame (1) is adapted to form a polygonal surface when the plurality of ribs (1) are fully expanded as shown in FIG. 1.

The composite canopy (2) includes a main canopy (20) secured on the polygonal surface of the support frame (1) and has an outer edge (201), and a loop-shaped auxiliary canopy (21) secured on the polygonal surface of the support frame (1) and located adjacent to the outer edge (201) of the main canopy (20). The main canopy (20) has a dimension smaller than the polygonal surface of the support frame (1), and has its outer edge (201) partially overlapping the inner edge (211) of the auxiliary canopy (21). The inner edge (211) of the auxiliary canopy (21) is located inside the outer edge (201) of the main canopy (20), thereby defining a gap (26) between the outer edge (201) of the main canopy (20) and the inner edge (211) of the auxiliary canopy (21).

The ventilated umbrella further comprises a plurality of elastic ropes (22) each having a first end secured to the shaft (10) of the support frame (1), and a second end secured to the inner edge (211) of the auxiliary canopy (21).

Referring now to FIGS. 1–4, the support frame (1) includes a retaining ring (13) secured on the shaft (10), and the first end of each of the elastic ropes (22) is attached to the retaining ring (13). The retaining ring (13) contains a plurality of locking holes (131) therein, and the first end of each of the elastic ropes (22) includes a locking hook (221) secured in one of the corresponding locking holes (131).

In operation, when the ventilated umbrella is fully expanded, the gap (26) between the outer edge (201) of the main canopy (20) and the inner edge (211) of the auxiliary canopy (21) is enlarged by means of the drawing force exerted by the elastic ropes (22) as shown in FIG. 3 such that the rate of air flowing through the gap (26) is greatly increased so as to enhance the convective effect of the air flowing into the main canopy (20), thereby increasing the ventilated effect of the ventilated umbrella.

In such a manner, the main canopy (20) has a small portion overlapping that of the auxiliary canopy (21). The inner edge (211) of the auxiliary canopy (21) is drawn and moved inward by the elastic ropes (22), thereby forming the gap (26) between the main canopy (20) and the auxiliary canopy (21) such that the main canopy (20) will not overlap the auxiliary canopy (21), thereby enhancing the ventilated effect of the ventilated umbrella.

It should be clear to those skilled in the art that further embodiments may be made without departing from the scope and spirit of the present invention.

What is claimed is:

1. A ventilated umbrella comprising:

a support frame (1) forming a polygonal surface and including a shaft (10) and a retaining ring (13) secured on said shaft (10);

a first canopy (20) secured on said polygonal surface of said support frame (1) and having an outer edge (201);

a loop-shaped second canopy (21) secured on said polygonal surface of said support frame (1) and having an inner edge (211) located under said outer edge (201) of said first canopy (20);

a gap (26) defined between said first canopy (20) and said second canopy (21); and a plurality of elastic members (22) each having a first end attached to said retaining ring (13) of said support frame (1), and a second end secured to said inner edge (211) of said second canopy (21).

2. The ventilated umbrella in accordance with claim 1, wherein said first canopy 20 has a dimension smaller than said polygonal surface of said support frame (1).

3. The ventilated umbrella in accordance with claim 1, wherein said retaining ring (13) contains a plurality of locking holes (131) therein, and said first end of each of said elastic members (22) includes a locking hook (221) secured in one of said corresponding locking holes (131).

* * * * *